US005954123A

United States Patent [19]

Richardson

[11] Patent Number: 5,954,123

[45] Date of Patent: Sep. 21, 1999

[54] HEAT EXCHANGER

[75] Inventor: Norman K. Richardson, Wickford, United Kingdom

[73] Assignee: Ford Global Technologies, Inc., Dearborn, Mich.

[21] Appl. No.: 08/661,526

[22] Filed: Jun. 11, 1996

[30] Foreign Application Priority Data

Jun. 12, 1995 [GB] United Kingdom ..... 9511853

[51] Int. Cl.[6] ..... F28F 9/00

[52] U.S. Cl. ..... 165/81; 165/149; 165/DIG. 480; 29/890.03

[58] Field of Search ..... 165/81, 149; 29/890.03

[56] References Cited

U.S. PATENT DOCUMENTS 4,534,407 8/1985 Lardner ..... 165/81
5,186,239 2/1993 Young et al. ..... 165/81
5,257,454 11/1993 Young et al. ..... 29/890.43

FOREIGN PATENT DOCUMENTS 1-131898 5/1989 Japan ..... 165/149
2 126 702 3/1984 United Kingdom .

*Primary Examiner*—Allen Flanigan
*Attorney, Agent, or Firm*—Raymond L. Coppiellie

[57] ABSTRACT

A heat exchanger includes a side support which has a thermal stress relieving zone in the form of a gap which completely separates one end of the support from the other. The gap is generally symmetrical about a central axis parallel to the longitudinal axes of the side supports of the heat exchanger and is shaped such that a straight line cannot be drawn through the gap from one side of the side support to the other side.

5 Claims, 3 Drawing Sheets

HEAT EXCHANGER

This invention is related to U.S. Pat. No. 5,186,239 and pending application Ser. No. 08/431,702.

BACKGROUND OF THE INVENTION

1. Field of the Invention

The present invention relates to a heat exchanger which has thermal stress relieving zones. The invention is for use particularly, though not exclusively, in a radiator for a motor vehicle.

2. Discussion of the Related Art

Typical vehicle heat exchangers, such as automobile radiators, include a plurality of thin walled tubes disposed between a pair of headers. The ends of the tubes are rigidly connected to the headers, and fluid can pass from one header to the other via the tubes. The tubes are interleaved with corrugated fins, and the tubes and fins are supported by a pair of side supports which extend between the headers and are rigidly secured thereto. The component parts of the heat exchanger are first assembled and then connected together by brazing or welding according to the materials from which each component is constructed.

A function of each side support is to limit deformation of the tubes close to the edge of the heat exchanger occurring as a result of internal pressure in the heat exchanger. The fins between the side support and the tube nearest to the side support are important for the transfer of loads between the tubes and the side support.

It is important to provide means for relieving thermally induced stress in the side support. This stress arises when coolant heats up the tubes, causing them to expand more rapidly than the side supports. If the side supports and the tubes are made from different materials, having different coefficients of thermal expansion, the stress build-up would be exacerbated. Longitudinal stress induced by this differential expansion can result in premature failure of the heat exchanger.

In a known design of heat exchanger, a thermal stress relieving zone comprises a linear saw cut made across each side support, which severs the side support completely through. A problem with saw cutting is that it is very noisy, difficult to automate, and produces a lot of metal fines resulting in increased downtime and maintenance of the saw.

It is-known to make a cut using a lancing technique, which requires the use of a side support which has a generally planar base portion and a pair of flanges extending generally longitudinally to the axes of the side supports. A linear slot is formed in the base by a stamping operation prior to securing the side support between the headers and to the fins. After the side support has been secured to the headers and the fins, the flanges are then sheared by a lancing technique at points adjacent the slot. The lancing completely fractures the flanges, forming the thermal stress-relieving zone as a gap which completely separates one end of the side support from the other end.

The lancing technique requires a relatively wide slot in order to provide an adequate target for the lance cutter. This technique reduces the problems associated with saw cutting, but with the resulting wide gap, the fin support necessary to transfer loads between the side support and the tube is locally lost, resulting in reduced fatigue life under repetitive pressure cycling.

It has been proposed in U.S. Pat. Nos. 5,165,153 and 5,257,454 to make a heat exchanger that includes a side support as described above having a gap disposed at an angle with respect to a plane perpendicular to the longitudinal axes of the side supports. These patents, which are incorporated herein by reference, also disclose an apparatus and a method for making the heat exchanger.

Such angular gaps in the side supports allow each adjacent fin to be supported by the side support on at least a part of its surface. However, they have a drawback of producing asymmetric stress patterns which may result in torsional moments on the side support, thus reducing the lifetime of the heat exchanger. Moreover, the manufacturing process is made more complicated because it is necessary to ensure that each radiator is correctly orientated during the cutting stage so that the parts of the flanges adjacent the slot are correctly positioned by the cutters. It is an object of the present invention to reduce at least one of the above mentioned problems.

SUMMARY OF THE INVENTION

According to the present invention, there is provided a heat exchanger comprising a frame including a pair of headers interconnected by elongated heat exchange fluid tubes and a pair of side supports. These side supports are rigidly connected to both headers at opposite ends of the headers, and they each include a generally planar base portion having a horizontal axis and a pair of flanges extending longitudinally to the axes of the side supports. This arrangement defines a plurality of air paths in which a plurality of fins are disposed. In addition, the side supports have a longitudinal axis and include a thermal stress relieving zone defined by a gap which completely separates one end of the side support from the other end. The zone is such that a straight line cannot be drawn through the gap from one side of the side support to the other.

Also disclosed is a method of manufacturing a heat exchanger having such thermal stress relieving zones. A heat exchanger is formed comprising a pair of headers, a pair of side supports rigidly connected to both headers, a plurality of elongate tubes, and a plurality of fins. Furthermore, these side supports are produced with a generally planar base portion and a pair of flanges extending generally longitudinally to the axes of the side supports. The base portion is then provided with a slot which extends from one flange to the other which is generally symmetrical about a central axis generally parallel to the longitudinal axes of the tubes. Finally, a thermal stress relieving zone is formed upon this heat exchanger by a shearing operation on at least one of the side supports. Both flanges adjacent to the slot are fractured, completely separating one end of the side support from the other. In this way, the shape of the slot is such that a straight line cannot be drawn through the slot from one flange to the other.

DESCRIPTION OF A PREFERRED EMBODIMENT

Figure 1:
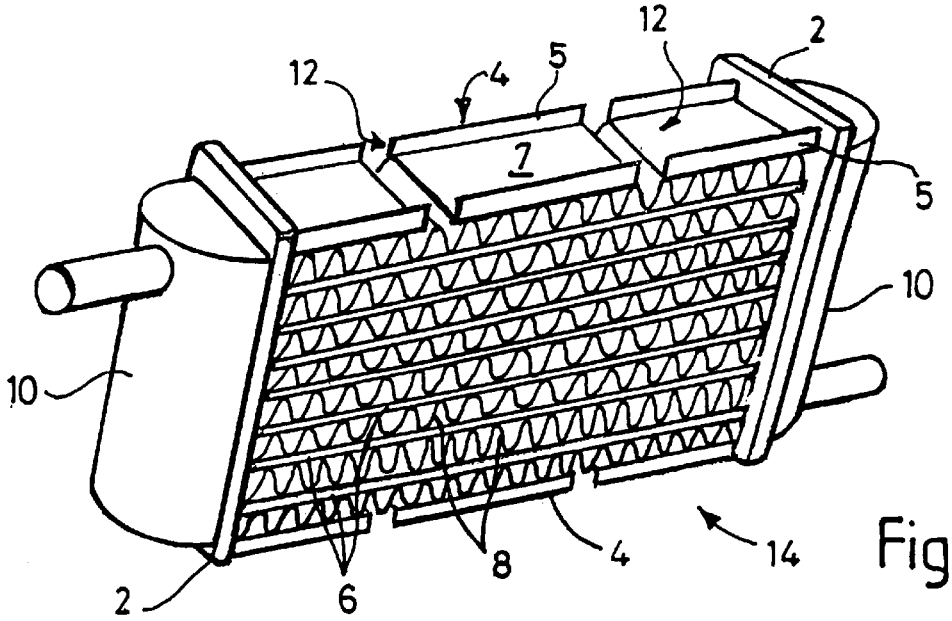
FIG. 1 is a perspective view of a vehicle radiator.

The assembled radiator 14 shown in FIG. 1 comprises a pair of headers 2 connected to fluid tanks 10. A plurality of thin walled tubes 6 are rigidly connected at each end bet ween the headers 2 so that coolant fluid may flow from one header to the other via the tubes 6. A pair of side supports 4 are disposed between the headers 2 and rigidly connected thereto, the headers 2 and side supports 4 forming a rigid frame.

Figure 2:
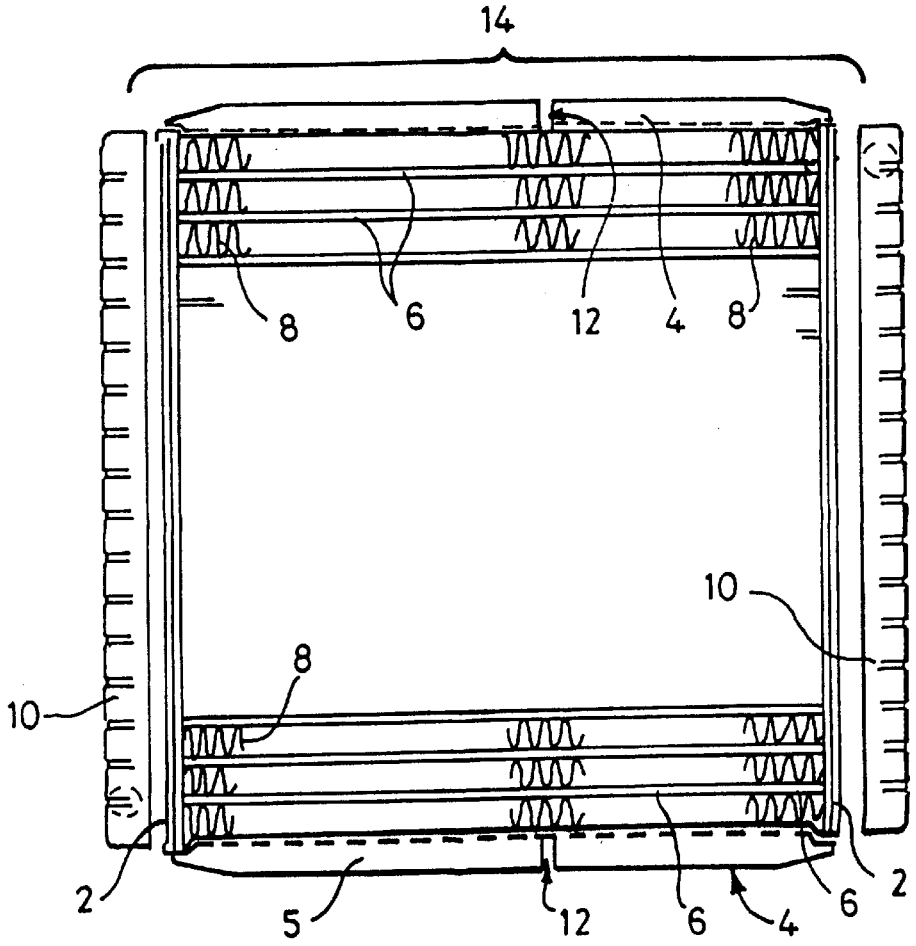
FIG. 2 is an exploded side elevation view of a vehicle radiator.

Each side support 4 comprises a generally planar portion 7 and a pair of flanges 5 which are generally longitudinal to the axes of the side supports 4. A plurality of corrugated fins 8 are disposed between each of the pipes 6 and between the pipes 6 and the side support 4, as best seen in FIG. 2 which shows a similar, though not identical, radiator 14.

Figure 5:
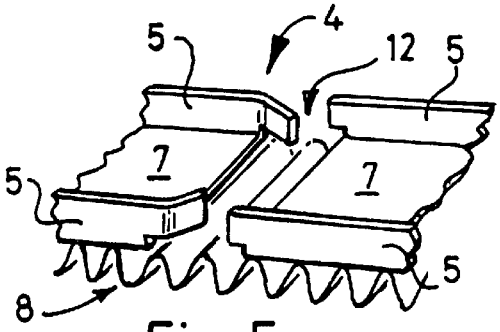
FIG. 5 is a perspective view of a side support of the radiator shown in FIG. 1.

Each side support 4 is provided with two gaps 12, made by lance cutting, as best shown in FIG. 5. As is known in the prior art, the side support 4 was formed with a linear slot which extended right across the base 7 between the junctions of the base 7 with the flanges 4. Subsequent to assembly and brazing of the radiator 14, both flanges 5 were sheared by a lance cutter so as to form the gaps 12. The gaps 12 relieve thermal stress between the pipes 6 and the side support 4. However, one or more of the fins 8 is not supported by or in contact with the side support 4 as shown in FIG. 5. Load transfer between the side support 4 and the nearest tubes is therefore lost, and the radiator 14 has a reduced fatigue life under repetitive pressure cycling.

Figure 4:
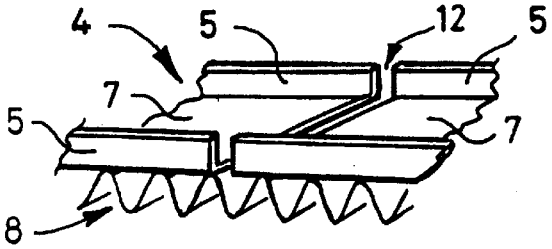
FIG. 4 is a perspective view of a side support which is provided with a known thermal stress relieving zone.

In an alternative known in the prior art, side support 4 shown in FIG. 4, has a thin gap 12 made by a saw. Because the gap is thinner than the width of contact between the side support 4 and a corrugation of the corrugated fins 8, each fin 8 is supported by the side support 4. However, making the gap 12 by means of a saw produces a lot of noise and generates a lot of metal fines which is undesirable.

The embodiments shown in FIG. 6 illustrate another known attempt to overcome the problems outlined with reference to FIGS. 4 and 5. Here, the side support 4 has been provided with a gap 12 by a lance cutting technique as described above. The relatively wide gap 12 is at an angle to an axis parallel with the side supports 4 which support all adjacent fins 8 along at least some of their surface.

Figure 6A:
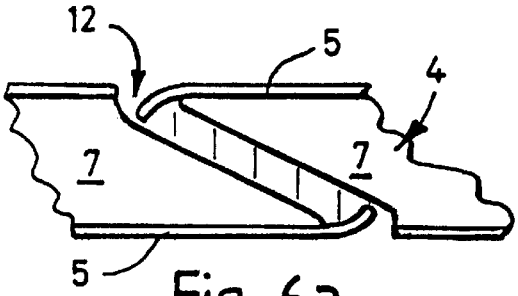
FIGS. 6*a* and 6*b* show perspective views of side supports in alternative designs of known radiators.
Figure 6B:
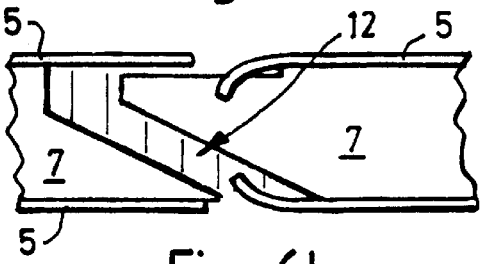

However, both the gap 12 produced by asymmetric lancing shown in FIG. 6*a,* and the gap 12 produced by symmetric lancing in FIG. 6*b* result in undesirable asymmetric stress distributions when the radiator is in operation. Such asymmetric stress patterns may cause torsional moments which may reduce the lifetime of the radiator. Also, the lance cutting operation must be performed with the radiator 14 in the correct orientation if the cuts are to be made in the correct locations in the flanges 5.

Figure 3:
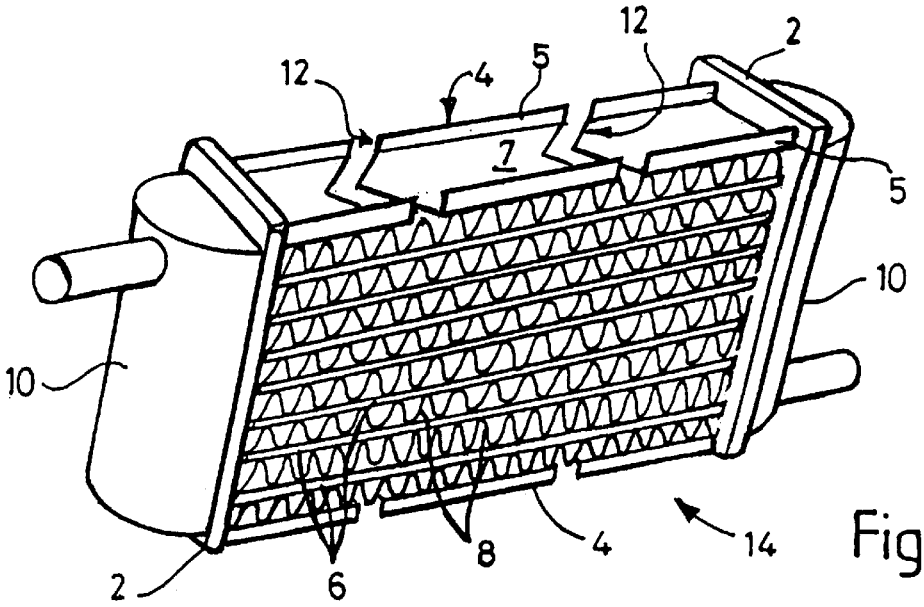
FIG. 3 is a perspective view of a vehicle radiator in accordance with one aspect of the present invention.
Figure 8:
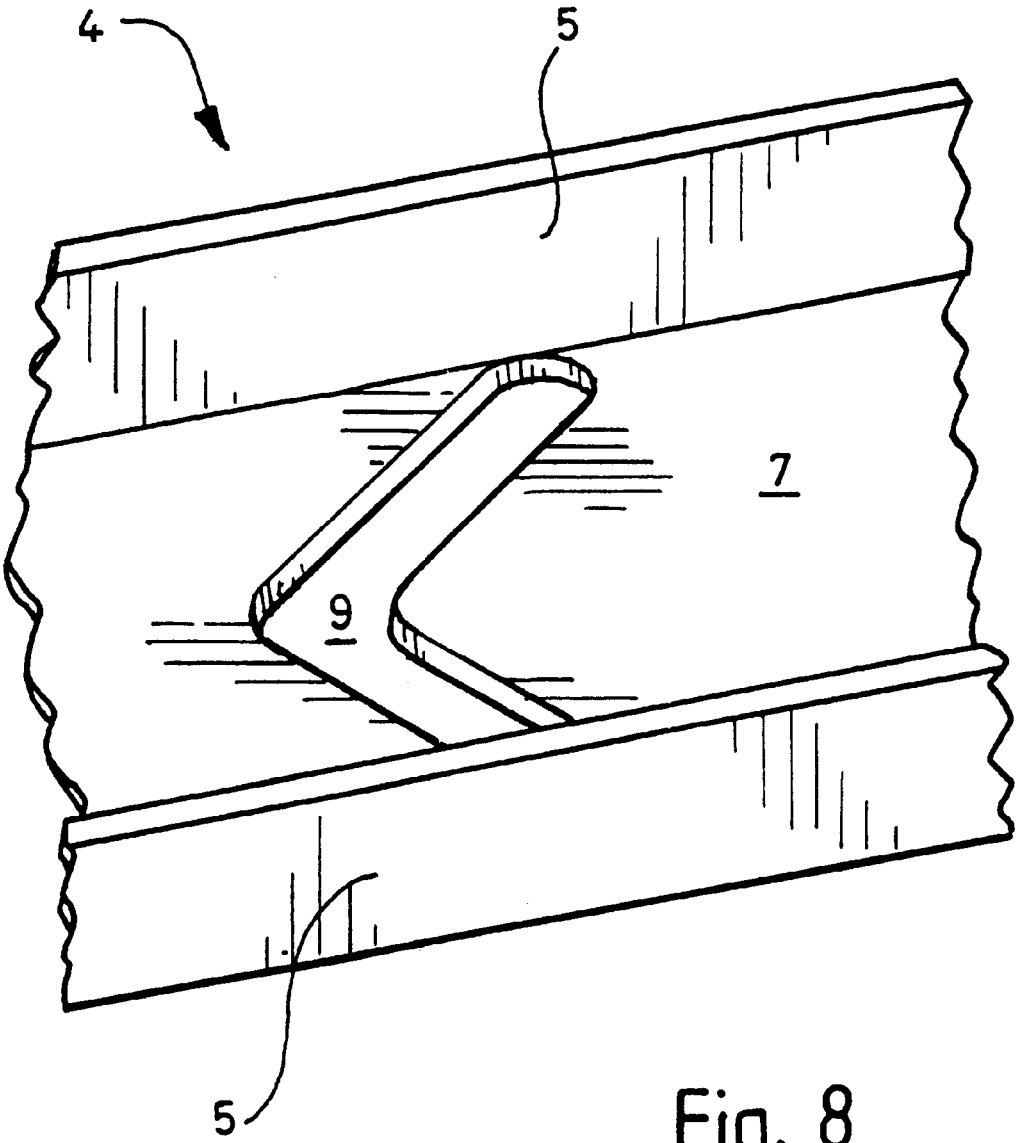
FIG. 8 is a perspective view of part of the side support shown in FIG. 7, prior to lance cutting.

In the preferred embodiment of the invention shown in FIG. 3, the side support 4 is provided with a generally V-shaped, or chevron-shaped, gap 12 which is symmetrical about a central axis parallel with the longitudinal axes of the tubes 6 and side support 4. The gap 12 is such that a straight line cannot be drawn through the gap 12 from one side of the side support 4 to the other side. The gap 12 was formed from a side support 4 having a chevron-shaped slot 9 in its base 1 by shearing the flanges 5 in a lance cutting operation similar to that described above. Part of the side support 4 prior to the lance cutting operation is shown in FIG. 8. The slot 9 may be manufactured in situ, but is preferably pre-formed, for example by a cutting or stamping process. Each fin 8 still receives local support from the base portion 7 of the side support 4 over at least a part of its surface, but additionally there is no, or very little, resulting asymmetric stress induced by the gap configuration, and consequently little or no torsional moment is induced in the side support.

Figure 7:
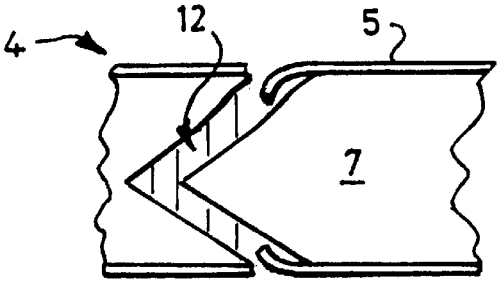
FIG. 7 is a perspective view of a novel side support of the radiator shown in FIG. 3.

Symmetrical gaps 12 such as shown in FIG. 7 may be made during the cutting operation regardless of the orientation of the radiator core. This allows easier and simpler manufacture of the radiator. The chevron shaped gap shown in FIG. 7 illustrates one possible shape of gap in a radiator in accordance with the invention. However, the invention is not limited to this embodiment. It is to be understood that many alternative non-linear shapes are also possible, for example U-shaped or arcuate gaps, provided that a straight line cannot be drawn through the gap from one side of the side support to the other and has a central symmetry axis which is generally parallel with the longitudinal axes of the side supports.

Various modifications and variations will no doubt occur to those skilled in the various arts to which this invention pertains. Such variations which basically rely on the teachings through which this disclosure has advanced the art are properly considered within the scope of this invention.

I claim:

1. A heat exchanger comprising a frame including a pair of headers, both being interconnected by a plurality of elongated heat exchange fluid tubes and a pair of side supports rigidly connected to both headers at opposite ends of said headers, each of said side supports including a generally planar base portion having a horizontal axis and a pair of flanges extending generally longitudinally to the axes of said side supports so as to define a plurality of air paths therebetween, a plurality of fins being disposed in the air paths, and said side supports having a longitudinal axis and including a thermal stress relieving zone defined by a gap which completely separates one end of the side support from the other end, and said zone is such that a straight line cannot be drawn through said gap from one side of said side support to the other.

2. A heat exchanger according to claim 1, wherein said thermal stress relieving zone is generally chevron shaped.

3. A heat exchanger according to claim 2, wherein said heat exchanger comprises an automotive radiator.

4. A method of manufacturing a heat exchanger having a thermal stress relieving zone therein, the method comprising the steps of:

forming a heat exchanger comprising a pair of headers, a pair of side supports rigidly connected to both headers, a plurality of elongate tubes disposed between said side supports and rigidly connected at each end to both of said headers so as to define a plurality of air paths therebetween, and a plurality of fins disposed in said air paths wherein at least one of said side supports comprising a generally planar base portion and a pair of flanges extending generally longitudinally to the axes of said side supports, the base portion being provided with a slot which extends from one flange to the other and which is generally symmetrical about a central axis generally parallel to the longitudinal axes of the tubes; and, forming a thermal stress relieving zone by a shearing operation on at least one of said side supports which carries said slot, so as to fracture both flanges adjacent said slot and completely separate one end of said side support from the other so that the shape of said slot is such that a straight line cannot be drawn through said slot from one flange to the other.

5. The method of claim 4, wherein said slot is generally chevron shaped.

* * * * *